US008542862B2

(12) United States Patent
Meguro et al.

(10) Patent No.: US 8,542,862 B2
(45) Date of Patent: Sep. 24, 2013

(54) FLAT ACOUSTIC TRANSDUCER AND METHOD FOR DRIVING THE SAME

(75) Inventors: Fumihito Meguro, Tokyo (JP); Tomomi Nakatsuka, Tokyo (JP); Masashi Hori, Tokyo (JP); Hiromi Sotome, Tokyo (JP); Masahiro Iwata, Tokyo (JP); Kuniyuki Kobayashi, Tokyo (JP)

(73) Assignee: FPS Inc., Tokyo (JP)

( * ) Notice: Subject to any disclaimer, the term of this patent is extended or adjusted under 35 U.S.C. 154(b) by 344 days.

(21) Appl. No.: 13/133,404

(22) PCT Filed: Nov. 30, 2009

(86) PCT No.: PCT/JP2009/006479

§ 371 (c)(1),
(2), (4) Date: Jun. 8, 2011

(87) PCT Pub. No.: WO2010/067531

PCT Pub. Date: Jun. 17, 2010

(65) Prior Publication Data

US 2011/0235848 A1 Sep. 29, 2011

(30) Foreign Application Priority Data

Dec. 8, 2008 (JP) ..... P2008-312656

(51) Int. Cl.

| | |
|---|---|
| ***H04R 1/00*** | (2006.01) |
| ***H04R 1/02*** | (2006.01) |
| ***H04R 9/06*** | (2006.01) |
| ***H04R 11/02*** | (2006.01) |

(52) U.S. Cl.
USPC ..... 381/400; 381/396; 381/431

(58) Field of Classification Search
USPC ..... 381/396, 399, 400, 406, 408, 409, 381/412, 414, 421, 423, 431, 176, 177, 191
See application file for complete search history.

(56) References Cited

U.S. PATENT DOCUMENTS 3,997,739 A * 12/1976 Kishikawa et al. ..... 381/408
4,242,541 A 12/1980 Ando (Continued)

FOREIGN PATENT DOCUMENTS

CN 2072300 U 2/1991
CN 1283067 A 2/2001

(Continued)

OTHER PUBLICATIONS

Korean Office Action dated May 18, 2012.

(Continued)

*Primary Examiner* — Tuan D Nguyen
(74) *Attorney, Agent, or Firm* — McGinn IP Law Group, PLLC

(57) ABSTRACT

A flat acoustic transducer (100) includes a permanent magnet (10) and a magnetic member (20), which are arranged adjacent to each other with a predetermined interval, a flat vibrating membrane (30), provided facing the permanent magnet (10) and the magnetic member (20), and at least one coil (40), fixed to the vibrating membrane (30). In the flat acoustic transducer (100), an electrical signal is applied to the coil (40), to obtain vibration force (F) on the vibrating membrane (30) by way of a magnetic flux Φ generated between a magnetic pole face (12) of the permanent magnet (10) and the magnetic member (20), a step (50) is provided between the magnetic pole face (12) and the upper face (22) of the magnetic member (20), while at least part of a winding (42) of the coil (40) at the time of no application of an electrical signal is arranged inside the step (50).

11 Claims, 9 Drawing Sheets

(56) References Cited

U.S. PATENT DOCUMENTS

| | | | | |
|---|---|---|---|---|
| 4,337,379 | A | 6/1982 | Nakaya | |
| 4,550,228 | A | 10/1985 | Walker et al. | |
| 5,901,235 | A * | 5/1999 | Thigpen et al. | 381/431 |
| 6,404,896 | B1 | 6/2002 | Yoo et al. | |
| 6,480,614 | B1 * | 11/2002 | Denda et al. | 381/423 |
| 6,593,847 | B2 | 7/2003 | Miyazaki et al. | |
| 6,934,402 | B2 | 8/2005 | Croft, III et al. | |
| 7,174,024 | B1 | 2/2007 | Suzuki et al. | |
| 7,231,058 | B2 | 6/2007 | Usuki et al. | |
| 2004/0086149 | A1 * | 5/2004 | Johannsen et al. | 381/412 |
| 2004/0136558 | A1 | 7/2004 | Usuki et al. | |
| 2007/0206830 | A1 | 9/2007 | Usuki et al. | |

FOREIGN PATENT DOCUMENTS

| | | | |
|---|---|---|---|
| CN | 1512818 | A | 7/2004 |
| EP | 1 073 312 | A2 | 1/2001 |
| JP | 52-37419 (A) | | 3/1977 |
| JP | 55-104893 | | 7/1980 |
| JP | 2001-333493 (A) | | 11/2001 |
| JP | 2004-364247 (A) | | 12/2004 |
| JP | 2008-141570 (A) | | 6/2008 |
| KR | 10-2002-0003573 | | 1/2002 |
| TW | M269678 | | 7/2005 |
| TW | 1255148 | | 2/2006 |
| WO | WO 00/78095 (A1) | | 12/2000 |

OTHER PUBLICATIONS

Chinese Office Action dated May 31, 2013 with partial English translation thereof.

Taiwanese Office Action dated Jul. 19, 2013 with partial translation.

* cited by examiner

FLAT ACOUSTIC TRANSDUCER AND METHOD FOR DRIVING THE SAME

TECHNICAL FIELD

The present invention relates to a flat acoustic transducer and a method for driving the same.

BACKGROUND ART

As conventional flat acoustic transducer (flat speaker), there are known ones obtained by fitting a plurality of permanent magnets to a base plane of a flat yoke such that the magnets adjacent to each other have opposite polarities, and arraying a plurality of spiral coils on a flat vibrating membrane facing the permanent magnets (see Patent Documents 1, 2). By application of an electrical signal to the coils, the coils receive magnetic force from magnetic pole faces of the permanent magnets, to vibrate above the permanent magnets.

In these flat acoustic transducers, the upper faces (magnetic pole faces) of the plurality of permanent magnets are configured flush with one another, and the magnetic pole face and the coil are spaced with a predetermined interval.

PRIOR ART DOCUMENTS

Patent Documents

[Patent Document 1] Japanese Laid-open patent publication No. 2001-333493

[Patent Document 2] Japanese Laid-open patent publication No. 2008-141570

DISCLOSURE OF THE INVENTION

In a flat speaker, when a current is applied to a coil so as to vibrate a vibrating membrane, the coil also vibrates along with the vibrating membrane. An amplitude distance of the vibration, for example, reaches the order of 1.0 mm at the maximum.

At this time, since heights of the upper faces of the plurality of permanent magnets arrayed on a yoke are made uniform, a degree of action of magnetic force upon the coil in the case of the coil being located at the lowest point of vibration is different from that in the case of the coil being located at the highest point. Herein, since magnetic force that acts upon the coil decreases in inverse proportion to the square of the distance between the magnetic pole face of the permanent magnet and the coil, when a current applied to the coil is constant, driving force that occurs on the vibrating membrane fluctuates in accordance with the position of the vibrating coil. As a consequence, there has occurred a problem in that a sound emitted from the flat speaker is distorted, to significantly impair reproducibility of an original sound.

The present invention was made in view of the above problem, and is to provide a flat acoustic transducer capable of faithfully reproducing an original sound, and a method for driving the flat acoustic transducer.

According to the present invention, there is provided a flat acoustic transducer comprising: a permanent magnet and a magnetic member which are arranged adjacent to each other with a predetermined interval; a flat vibrating membrane provided facing the permanent magnet and the magnetic member; and at least one coil fixed to the vibrating membrane, wherein an electrical signal is applied to the coil, to obtain vibration force on the vibrating membrane by way of a magnetic flux generated between a magnetic pole face of the permanent magnet and the magnetic member, a step is provided between the magnetic pole face and the upper face of the magnetic member, and at least part of a winding of the coil at the time of no application of the electrical signal is arranged inside the step.

Herein, in a static magnetic field generated by the permanent magnet, a magnetic flux density is maximal in an area from the magnetic pole face of the permanent magnet toward the upper face as an edge line of the adjacently arranged magnetic member. Therefore, providing the step between the magnetic pole face of the permanent magnet and the upper face of the magnetic member leads to formation of an area with a maximal magnetic flux density inside such a step. Accordingly, arranging the coil at the time of no application of an electrical signal inside the step can make equalize the magnetic force received by the coil in the case of downward vibration of the vibrating membrane and that in the case of upward vibration thereof.

Further, in the flat acoustic transducer of the present invention, as a more specific aspect, at least part of the winding of the coil at the time of no application of the electrical signal may be arranged at such a height position that a density of the magnetic flux component parallel to a coil face of the coil may be maximal.

Further, in the flat acoustic transducer of the present invention, as a more specific aspect, at least part of the winding of the coil at the time of no application of the electrical signal may be arranged at a middle height position between the magnetic pole face and the upper face, and above a line segment connecting respective proximal edges of the magnetic pole face and the upper face.

Further, in the flat acoustic transducer of the present invention, as a more specific aspect, the magnetic member may be another permanent magnet with a magnetic pole face having a polarity inverted from that of the adjacent permanent magnet.

Further, in the flat acoustic transducer of the present invention, as a more specific aspect, the coil may be provided projecting from the vibrating membrane toward the permanent magnet or the magnetic member.

Further, in the flat acoustic transducer of the present invention, as a more specific aspect, a winding axis of the coil may coincide with a central axis of the magnetic pole face or the upper face.

Further, in the flat acoustic transducer of the present invention, as a more specific aspect, a yoke may be further provided which is made of a magnetic material and provided with a step for mounting of the permanent magnet or the magnetic member.

Further, in the flat acoustic transducer of the present invention, as a more specific aspect, the yoke may have extending side wall sections on sides with respect to an arraying direction of the permanent magnets and the magnetic members.

Further, in the flat acoustic transducer of the present invention, as a more specific aspect, a respective plurality of the permanent magnets and magnetic members may be repeatedly arranged by pattern in a one-dimensional direction or two-dimensional directions.

Further, in the flat acoustic transducer of the present invention, as a more specific aspect, at least either the permanent magnet or the magnetic member may form a ring shape, while the permanent magnet and the magnetic member may be concentrically arranged.

According to the present invention, there is provided a method for driving a flat acoustic transducer that has a flat vibrating membrane fixed with at least one coil applied with an electrical signal, wherein a static magnetic field is generated such that a density of a magnetic flux component parallel to a coil face of the coil changes in a vibrating direction of the vibrating membrane, and the electrical signal is applied to the coil arranged at such a position that the density of the magnetic flux component is maximal, to vibrate the vibrating membrane.

It is to be noted that a variety of constitutional elements of the present invention are not necessarily present in an individual and independent manner, but a plurality of constitutional elements may be formed as one member, one constitutional element may be formed of a plurality of components, a certain constitutional element may be part of another constitutional element, or part of a certain constitutional element may overlap with part of another constitutional element in some other way.

Further, although the vertical direction is defined in the present invention, this definition was made for the sake of convenience in simply describing a relative relation of the constitutional elements of the present invention, and does not restrict a direction at the time of manufacturing or use in the case of implementing the present invention.

According to the flat acoustic transducer and the method for driving the same in the present invention, the magnetic force received from the permanent magnet in the case of downward vibration of the coil located at the center of vibration and the magnetic force in the case of upward vibration of the coil are made equal, thereby allowing faithful reproduction of an original sound regardless of the vibrating position of the coil.

BRIEF DESCRIPTION OF THE DRAWINGS

The above and other objects, features and advantages will be more apparent from the following description of preferred embodiments and the following drawings associated therewith.

BEST MODE FOR CARRYING OUT THE INVENTION

In the following, embodiments of the present invention will be described based upon the drawings. It is to be noted that in every drawing, the same constitutional element is provided with the same numeral, and description thereof will not be repeated.

First Embodiment

Figure 1:
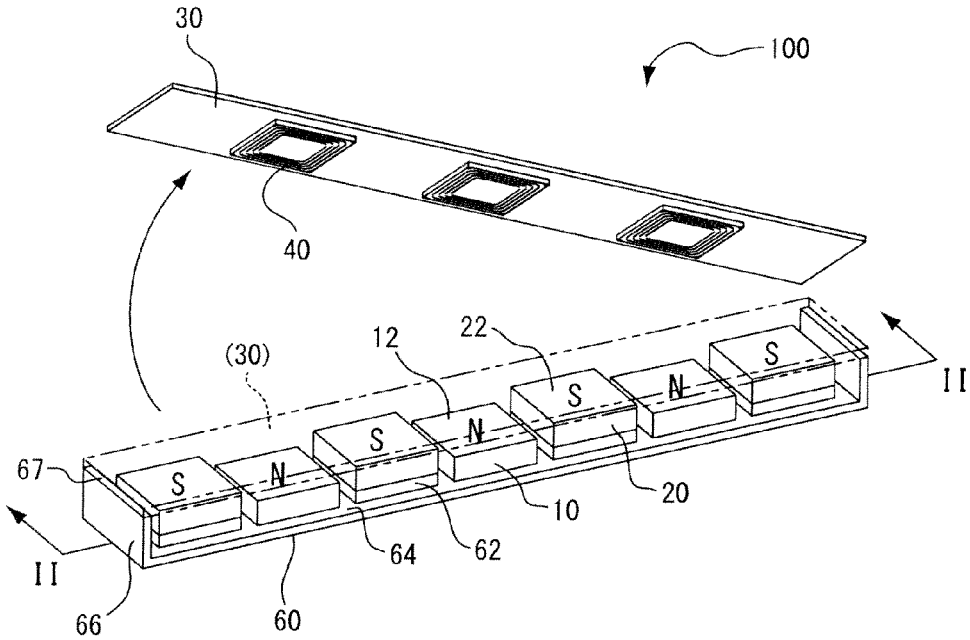
FIG. 1 is a top perspective view showing a flat acoustic transducer according to a first embodiment.

FIG. 1 is a top perspective view showing a flat acoustic transducer 100 according to a first embodiment of the present invention. In the drawing, a vibrating membrane 30 in the state of being fixed to a yoke 60 is indicated by chain double-dashed lines, while a state of the under face side of the vibrating membrane 30 is indicated by solid lines.

Figure 2A:
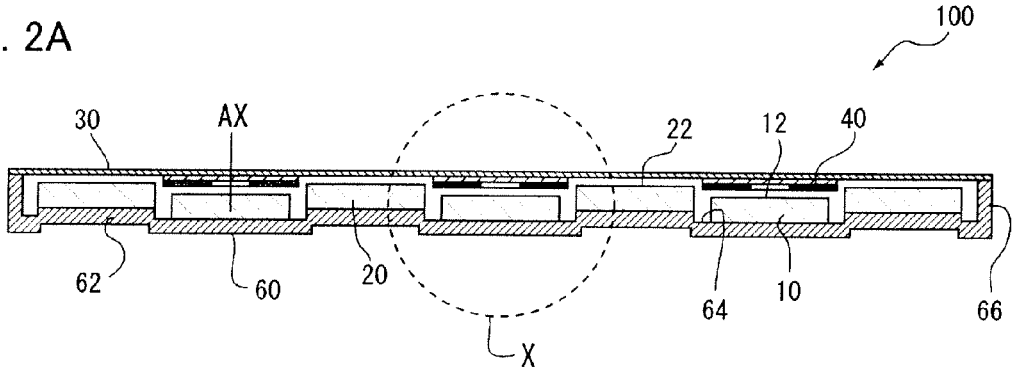
FIG. 2A is a sectional view of II-II of FIG. 1.
Figure 2B:
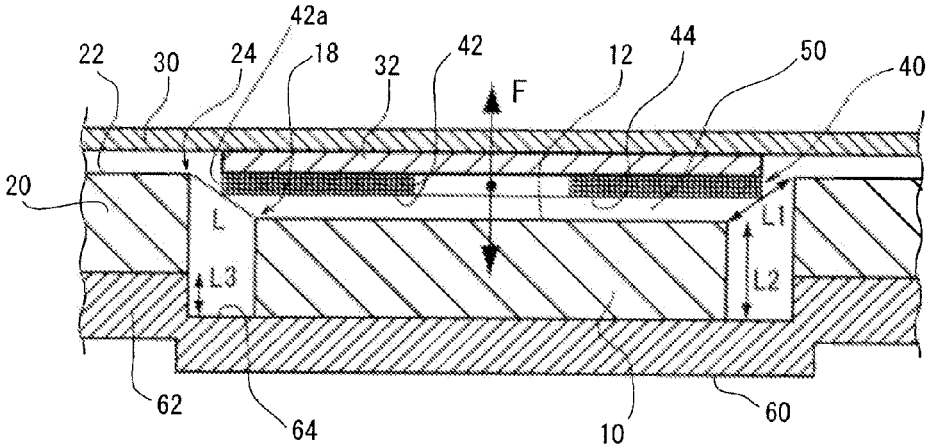
FIG. 2B is an expanded view of a broken-line area X of FIG. 2A.
Figure 2C:
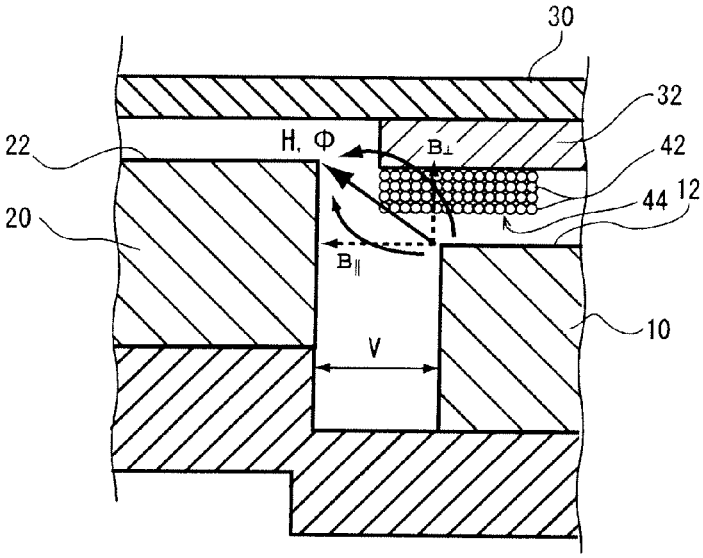
FIG. 2C is an explanatory view of an action of the flat acoustic transducer.

FIG. 2A is a sectional view of II-II of FIG. 1. FIG. 2B is an expanded view of a broken-line area X of FIG. 2A. FIG. 2C is an explanatory view of an action of the flat acoustic transducer 100 in the present embodiment. Further, a coil 40 shown in each drawing of FIG. 2 represents a position at the time of no application of an electrical signal.

First, a brief overview of the flat acoustic transducer 100 of the present embodiment will be described.

The flat acoustic transducer 100 includes a permanent magnet 10 and a magnetic member 20 which are arranged adjacent to each other with a predetermined interval, a flat vibrating membrane 30 provided facing the permanent magnet 10 and the magnetic member 20, and a coil 40 fixed to the vibrating membrane 30, and an electrical signal is applied to the coil 40, to obtain vibration force F (see FIG. 2B) on the vibrating membrane 30 by way of a magnetic flux Φ generated between a magnetic pole face 12 of the permanent magnet 10 and the magnetic member 20.

In the flat acoustic transducer 100, a step 50 is provided between the magnetic pole face 12 and the upper face 22 of the magnetic member 20, while at least part of a winding 42 of the coil 40 at the time of no application of an electrical signal is arranged inside the step 50.

Next, the flat acoustic transducer 100 of the present embodiment will be described in detail.

The magnetic member 20 for use in the present invention is a member made of a magnetic body, for which a permanent magnet as a magnetized magnetic body or a non-magnetized magnetic body may be used.

Out of these, another permanent magnet with a magnetic pole face having a polarity inverted from the magnetic pole face 12 of the adjacent permanent magnet 10 is used as the magnetic member 20 in the present embodiment. That is, the upper face 22 of the magnetic member 20 is a magnetic pole face with its polarity being the north pole or the south pole, which is inverted from the polarity of the magnetic pole face 12 of the permanent magnet 10.

Hereinafter, the permanent magnet 10 is referred to as a first magnet, and the magnetic member 20 as a second magnet, and those will be described, being provided with a common numeral.

The flat acoustic transducer 100 of the present embodiment further includes the yoke 60, which is made of a magnetic material and provided with a step 62 for mounting of the first magnet (permanent magnet) 10 or the second magnet (magnetic member) 20.

FIG. 1 shows one, as the yoke 60, with the step 62 formed projecting from a base plane 64 corresponding to the upper face of the drawing. However, a concavity/convexity of the step 62 may be reversed, to form the step 62 depressing from the base plane 64.

The first magnet 10 is mounted on the base plane 64 of the yoke 60. The second magnet 20 is then mounted on the step 62 of the yoke 60. With the yoke 60 being made of a magnetic material, the first magnet 10 and the second magnet 20 can be attached to the yoke 60 by magnetic force so as to be mounted thereon. The first magnet 10 and the second magnet 20 may be fixed to the yoke 60 by bonding, using a bonding unit such as an adhesive, or may be subjected to both attachment by magnetic force and fixation by bonding.

The magnetic pole face 12 of the first magnet 10 and the upper face (magnetic pole face) 22 of the second magnet 20 are mounted on the yoke 60 with polarities of those magnets inverted from each other.

It is to be noted that, when the first magnet 10 is referred to as "magnetic pole face 12" in regard to the first magnet 10 without a particular explanation, it means the magnetic pole face on the upper face side thereof.

The first magnet 10 and the second magnet 20 of the present embodiment are formed in the same shape and dimensions.

Thereby, the second magnet 20 mounted on the step 62 is located at a higher position than the first magnet 10 mounted on the base plane 64. The upper face 22 of the second magnet 20 is located at a higher position than the magnetic pole face 12 on the upper face side of the first magnet 10 by a height of the projection (a distance L3 shown in FIG. 2B) of the step 62.

It should be noted that in the present embodiment, the vertical direction and high/low are defined with the base plane 64 of the yoke 60 taken as a reference. This does not necessarily coincide with the vertical direction of the gravity.

The step 62 of the yoke 60 is provided for the purpose of forming a height difference between the magnetic pole face 12 of the first magnet 10 and the upper face (magnetic pole face) 22 of the second magnet 20. Therefore, in the case of making the height difference between the first magnet 10 and the second magnet 20, the step 62 is not required, allowing the yoke 60 to be formed in flat plate shape. In other words, forming the step 62 in convexo-concave shape on the yoke 60 allows the first magnet 10 and the second magnet 20 to have the same dimensions, thereby contributing to reduction in number of components.

It should be noted that in the case of using as the magnetic member 20 a non-magnetized magnetic body instead of the permanent magnet as in the present embodiment, the yoke 60 and the magnetic member 20 may be configured to be separate members, or may be integrally configured. In the case of integrally constituting the yoke 60 with the magnetic member 20, a projecting section corresponding to the magnetic member 20 is formed by projection from the base plane 64 between the discretely arranged permanent magnets 10.

On the base plane 64 of the yoke 60, a plurality of steps 62 is formed with predetermined intervals.

In the flat acoustic transducer 100 of the present embodiment, a respective plurality of first magnets (permanent magnets) 10 and second magnets (magnetic members) 20 are repeatedly arranged by pattern in a one-dimensional direction. As shown in FIG. 2C, the first magnet 10 and the second magnet 20 are arranged with an interval from each other in a repeating direction (horizontal direction of the drawing).

In the flat acoustic transducer 100 of the present embodiment, the interval between the first magnet (permanent magnet) 10 and the second magnet (magnetic member) 20 adjacent thereto means a distance between these magnets in regard to an in-plane direction of the base plane 64 (horizontal direction of FIG. 2).

Further, in the present embodiment, the interval between the first magnet 10 and the second magnet 20 is made the same with respect to each repeated pattern. However, as described later, the interval between the magnets in the vicinity of the center of the base plane 64 may be made different from the interval between the magnets in the vicinity of the periphery.

Further, as for the height of the step 50 between the magnetic pole face 12 of the first magnet 10 and the upper face 22 of the second magnet 20, the height with respect to each pair of the adjacent magnets may be made common or different.

The yoke 60 is provided with erecting walls 66 erecting upward from the base plane 64 at both ends of the repeating direction (longitudinal direction) of the first magnet 10 and the second magnet 20. The vibrating membrane 30 is vibratorily fitted to an upper end face 67 of the erecting wall 66.

The vibrating membrane 30 is formed of a thin flexible sheet made of a polymeric material such as polyimide, polyethylene terephthalate (PET), or liquid crystal polymer. Further, the above is not restrictive, but a non-magnetized metal plate, such as aluminum, may also be used. Especially in the case of using the non-magnetized metal plate, with the plate being lightweight and having suitable hardness, it is possible to obtain an advantage of further improving reproducibility of an original sound.

The coil 40 is formed on one face or both faces of the vibrating membrane 30. A wire material and a winding pattern for the coil 40 of the present embodiment are not particularly restricted so long as the coil 40 is one receiving a magnetic flux Φ from the first magnet 10 and the second magnet 20 at the time of application of an electrical signal to receive magnetic force in a perpendicular direction to the plane of the vibrating membrane 30. The electrical signal in the present embodiment means an input signal for vibrating the vibrating membrane 30 to make a vocal output.

Preferable examples of the coil 40 may include a winding coil formed by winding wires and a patterning coil (film coil) formed by making a metal material coat on or adhere to a flexible substrate. In the case of the winding coil, it may be a cored coil or an air-core coil.

In the present embodiment, the wires and the pattern constituting the coil 40 is collectively referred to as a winding.

Further, the wire-winding pattern of the coil 40 is also not particularly restricted, but may be one including a line area extending in a direction across an orientation of the magnetic flux Φ generated between the first magnet 10 and the second magnet 20. A specific wire-winding pattern may be wire-winding in multiple layers with the same diameter, wire-winding in spiral shape with varied winding diameters within the same layer, wire-winding not by turning-around but meandering of wires, or wire-winding by combination of these.

In the case of the coil 40 being a winding coil, since a sectional area of the wire can be made large as compared with the patterning coil, it is possible to make a resistance component low, so as to obtain a high output of the flat acoustic transducer 100.

Meanwhile, in the case of the coil 40 being the patterning coil, since a weight of the coil can be held small, the vibrating membrane 30 is excellent in responsiveness to vibration, and the whole of the flat acoustic transducer 100 can be reduced in weight.

As the coil 40 of the present embodiment, a wire-wound air-core coil is used. As shown in each drawing of FIGS. 2A to 2C, a plurality of wires is wound both in a winding diameter direction and a winding thickness direction.

In the present embodiment, a plurality of coils 40 is provided as mutually spaced from one another in the repeating direction of the first magnet (permanent magnet) 10 and the second magnet (magnetic member) 20. The plurality of coils 40 is electrically connected to one another.

In the flat acoustic transducer 100 of the present embodiment, the number of turns and a winding thickness of the winding 42 is common with respect to each coil 40. However, as described later, the number of turns and the winding thickness of the coil 40 arranged in the vicinity of the center of the vibrating membrane 30 and the number of turns and the winding thickness of the coil 40 arranged in the vicinity of the periphery may be made different from one another.

The coil 40 is arranged in an area corresponding to at least either the first magnet 10 or the second magnet 20 in the plane of the vibrating membrane 30. In other words, the coil 40 is formed surrounding at least part of the area facing the first magnet 10 or the second magnet 20.

It should be noted that, although the coil 40 is provided only on one side (lower face side) of the principal face of the vibrating membrane 30 in the present embodiment, an additional coil 40 may be arranged as laminated on the opposite-side principal face of the vibrating membrane 30 or inside the film thickness of the vibrating membrane 30.

The coil 40 of the present embodiment is provided projecting from the vibrating membrane 30 toward the first magnet (permanent magnet) 10 or the second magnet (magnetic member) 20.

A winding axis AX of the coil 40 coincides with a central axis of the magnetic pole face 12 of the first magnet (permanent magnet) 10 or the upper face (magnetic pole face) 22 of the second magnet (magnetic member) 20.

More specifically, in the flat acoustic transducer 100 of the present embodiment, the winding axis AX of the coil 40 is made to coincide with the first magnet 10 located at a lower position than the second magnet 20.

An inner diameter of the coil 40 of the present embodiment is smaller than outer dimensions of the magnetic pole face 12 of the first magnet 10, while an outer diameter of the coil 40 is larger than outer dimensions of the magnetic pole face 12 of the first magnet 10.

Herein, the outer diameter of the coil 40 is smaller than a distance from the center of the first magnet 10 to the second magnet 20. In other words, the winding 42 on the outermost periphery of the coil 40 is present in an inner area of a gap V between the first magnet 10 and the second magnet 20. This prevents the vibrating coil 40 from interfering with the second magnet 20. It is to be noted that in the present embodiment, the winding 42 may mean each wire-wound turn.

As shown in FIG. 2B, a distance L1 between the magnetic pole face 12 and a proximal edge 24 of the upper face 22 of the second magnet 20 is shorter than a distance L2 between the magnetic pole face 12 and the base plane 64 of the yoke 60. Further, as shown in FIG. 1, the upper-face side magnetic pole face 12 of the first magnet 10 is the north pole.

Accordingly, within a vertical cross section (see FIGS. 2B, 2C) of a static magnetic field H generated by the magnetic pole face 12 of the first magnet 10, a density of a magnetic flux Φ is maximal on or slightly above a line segment L connecting a peripheral edge 18 of the magnetic pole face 12 and the proximal edge 24 of the upper face 22, both being edges adjacent to each other. Then a component in a horizontal direction of the density of the magnetic flux, namely, a component in a winding-diameter direction of the coil 40 (horizontal direction of the drawing), is also maximal in a position almost on the line segment L.

Then, at least part of winding 42 of the coil 40 at the time of no application of an electrical signal is arranged at such a height position that the density of the magnetic flux component parallel to a coil face 44 of the coil 40 is maximal in the magnetic flux Φ.

Thereby, magnetic force received by the winding 42 from the first magnet 10 and the second magnet 20 is maximal at the center (antinode) of vibration.

FIG. 2C shows a horizontal component ($B_{\parallel}$) and a vertical component ($B\perp$) of the magnetic flux Φ generated on the line segment L. The horizontal component $B_{\parallel}$ is a magnetic flux component that coincides with the coil face 44 as a wire-wound face of the winding 42, and the vertical component $B\perp$ is a magnetic flux component that coincides with the winding axis AX of the winding 42. That is, the horizontal component $B_{\parallel}$ and the vertical component $B\perp$ are vector components of the magnetic flux Φ. The horizontal component $B_{\parallel}$ is then orthogonal to an electrical signal flowing in the winding 42.

Therefore, the winding 42, having a center of vibration inside the magnetic flux Φ where the horizontal component $B_{\parallel}$ is maximal, receives reduced magnetic force both in the case of upward movement of the coil 40 from the center of the vibration and in the case of downward movement of the coil 40 from the center of the vibration.

For this reason, driving force received by the vibrating membrane 30 in the case of the coil 40 reaching a bottom dead center of an amplitude is made equal to that in the case of the coil 40 reaching a top dead center, thereby improving reproducibility of an original sound of the flat acoustic transducer 100, especially reproducibility in the case of the coil 40 vibrating upward.

Further, at least part of the winding 42 of the coil 40 at the time of no application of an electrical signal is arranged at a middle height position of between the magnetic pole face 12 and the upper face 22, and above the line segment L connecting respective proximal edges (the peripheral edge 18 and the proximal edge 24) of the magnetic pole face 12 and the upper face 22.

More specifically, at the time of no application of an electrical signal, a winding 42*a* in the coil 40, which corresponds to the center of the winding thickness direction and the outermost periphery (see FIG. 2B), is preferably located on or above the line segment L. Further, at the time of no application of an electrical signal, part of the winding of the coil 40 is preferably present below the line segment L, and another part thereof is preferably present above the line segment L.

Regarding FIGS. 2B and 2C, in the static magnetic field H generated by the first magnet 10 and the second magnet 20, more specifically, a magnetic flux density above the line segment L connecting the peripheral edge 18 of the magnetic pole face 12 and the proximal edge 24 of the upper face 22 is higher than a magnetic flux density below the line segment L. This is because the permanent magnet generally generates the stronger static magnetic field H on the outside in the axial direction thereof than on the magnetic pole faces of both sides thereof.

Therefore, at least part of the winding of the coil 40 may be arranged to have a height of the center of vibration slightly above the line segment L. This can make equal magnetic force received at the top dead center of the amplitude and magnetic force received at the bottom dead center in regard to the whole of the coil 40.

The bottom dead center of vibration of the coil 40 is above the magnetic pole face 12 of the first magnet 10, and the winding 42 of the coil 40 does not interfere with the magnetic pole face 12. That is, the lower end position of vibration of the coil 40 is present above the upper face of one present at a lower position out of the first magnet (permanent magnet) 10 and the second magnet (magnetic member) 20. The coil 40 then vibrates inside, and in a space above, the step 50.

In the vibrating membrane 30, a mount section 32 made of a non-magnetized material is provided projecting on the lower face side. The coil 40 is mounted on the mount section 32. The mount section 32 may be integrally provided with the vibrating membrane 30, or may be made in plate shape with a predetermined thickness and joined to the lower face side of the vibrating membrane 30. Further, part of the mount section 32 in plate shape may be provided erecting vertically to the vibrating membrane 30, so as to serve as a bobbin section for wire-winding of the winding 42 of the coil 40. That is, a columnar section corresponding to the bobbin section and a plate section formed in flanged shape on the upper end of the columnar section may constitute the mount section 32.

The mount section 32 is a spacer for ensuring a distance in the thickness direction between the vibrating membrane 30 and the coil 40. Providing such amount section 32 adjusts the distance between the magnetic pole face 12 of the first magnet 10 and the coil 40 to the predetermined one, while preventing the vibrating membrane 30 that vibrates and the second magnet 20 from interfering with each other.

Actions and effects of the flat acoustic transducer 100 of the present embodiment are described.

In the flat acoustic transducer 100 of the present embodiment, with the step 50 provided between the first magnet 10 and the second magnet 20, the area where the magnetic flux density generated by the permanent magnet is maximal, namely the line segment L connecting the respective proximal edges is oblique to a normal of the magnetic pole face of the permanent magnet. On such a line segment L, the magnetic flux density of the horizontal component $B_{||}$ of the magnetic flux $\Phi$ is maximal. Therefore, in the flat acoustic transducer 100 of the present embodiment in which the winding 42 of the coil 40 is arranged on the line segment L, the winding 42 and the magnetic pole face do not interfere with each other, to maximize magnetic force received by the winding 42 at the center of vibration. This substantially symmetrizes magnetic force received by the coil 40, regardless of the vibrating direction of the coil 40, so as to improve reproducibility of an original sound of the flat acoustic transducer 100.

Further, as shown in FIG. 1, the flat acoustic transducer 100 configured by arranging the first magnet 10 and the second magnet 20 in a row can be reduced in width dimension. For this reason, for example, an application to a space-restricted spatial domain such as a frame section of a flat-screen television is possible.

Further, the coil 40 of the present embodiment is provided projecting from the vibrating membrane 30 toward the first magnet 10. Hence the coil 40 makes use of the inside of the step 50 as a vibration space, and the first magnet 10 and the second magnet 20 are prevented from interfering with the vibrating membrane 30, whereby it is possible to obtain the flat acoustic transducer 100 which is thinned in total.

Herein, a brief overview of a method for driving the flat acoustic transducer 100 of the present embodiment (which may hereinafter be referred to as present method) will be described.

The present method relates to the method for driving the flat acoustic transducer 100 with the vibrating membrane 30 fixed with the coil 40 to which an electrical signal is applied.

The present method is to generate the static magnetic field H in which the density of the magnetic flux component (horizontal component $B_{||}$) parallel to the coil face 44 of the coil 40 changes in the vibrating direction of the vibrating membrane 30, while applying an electrical signal to the coil 40 arranged at such a position that the magnetic flux density is maximal, to vibrate the vibrating membrane 30.

According to the present method, magnetic force received by the coil 40 from the static magnetic field H by application of the electrical signal is maximal in the position where the coil 40 is arranged. Therefore, in whichever vibrating direction the coil 40 moves from such an arranged position, driving force to be given to the vibrating membrane 30 is symmetrized, thereby reducing distortion of a sound in the flat acoustic transducer 100, to improve reproducibility of an original sound.

It should be noted that a variety of modifications are permitted in regard to the present embodiment.

Figure 3A:
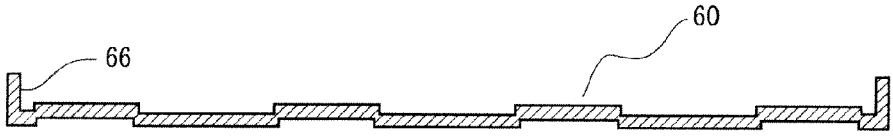
FIG. 3A is a side view of a yoke.

FIG. 3A is a side view of the yoke 60 of the present embodiment shown in each drawing of FIGS. 2A to 2C. The yoke 60 of the present embodiment is provided with the erecting walls 66 for fixing the vibrating membrane 30 (not shown in the drawing) to both ends of the longitudinal direction (horizontal direction in FIG. 3A).

Figure 3B:
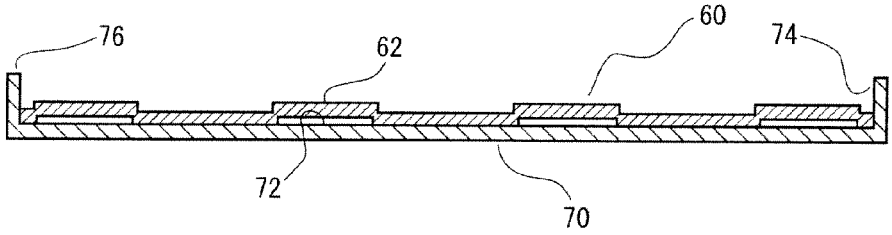
FIG. 3B is a side view showing a modification of the yoke.

On the other hand, FIG. 3B is a side view showing a modification of the yoke 60. The yoke 60 according to the modification is not provided with the erecting wall, but formed totally flat except for the step 62. The yoke 60 of the present modification may be mounted on a frame 70. The frame 70 is made of a magnetic material or a non-magnetic material, and includes a flat bottom face 72 mounted with the yoke 60, and erecting walls 74 provided erecting at both ends of the longitudinal direction of the bottom face 72. The edge of the vibrating membrane 30 can be fitted to a top end face 76 of the erecting wall 74. Further, the frame 70 may be provided with a circuit section (not shown in the drawing) for supplying an electrical signal to the coil. Forming such a frame 70 separately from the yoke 60 can prevent workability from being impaired at the time of positioning the first magnet and the second magnet with high accuracy.

Second Embodiment

Figure 4:
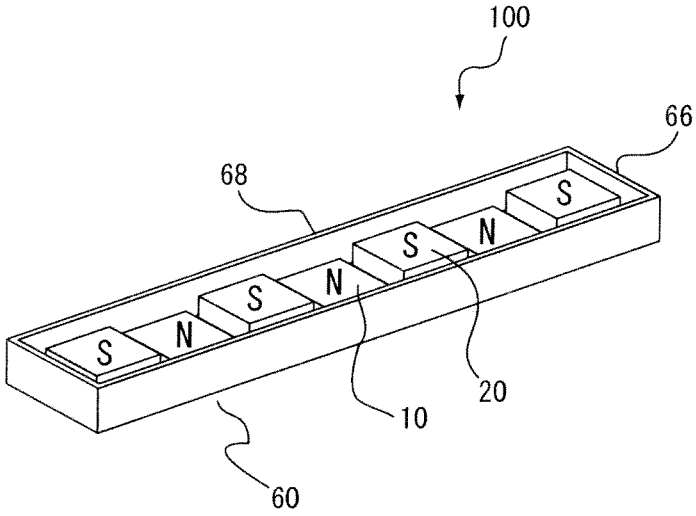
FIG. 4 is a top perspective view showing a flat acoustic transducer according to a second embodiment.

FIG. 4 is a top perspective view showing the flat acoustic transducer 100 according to the present embodiment. However, the vibrating membrane and the coils are not shown in the drawing.

The yoke 60 of the present embodiment has side wall sections 68 extending lateral to the arraying direction of the first magnets (permanent magnets) 10 and the second magnets (magnetic members) 20.

The side wall sections 68 are connected with the erecting walls 66 provided at both ends of the arraying direction of the yoke 60, to surround the yoke 60.

The side wall section 68 is made of a magnetic material of the same kind as or different one from that for the yoke 60. Thereby, a magnetic circuit is also formed in the vertical direction to the arraying direction of the first magnets 10 and the second magnets 20 among in-plane directions of the vibrating membrane, whereby a magnetic field passing through the coil is strengthened, while being made totally uniform. Therefore, according to the flat acoustic transducer 100 of the present embodiment, output efficiency is high as compared with the first embodiment, thereby allowing stable reproduction of an original sound. It is to be noted that the erecting walls 66, 74 and the side wall section 68 may be combined with one another, or separately provided.

Third Embodiment

Figure 5:
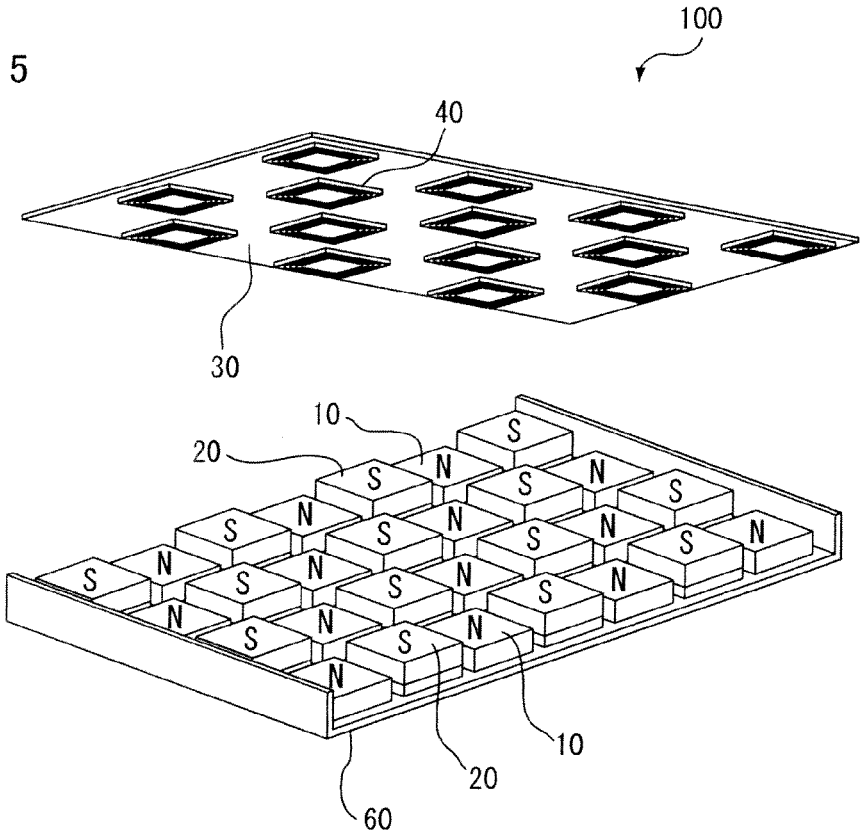
FIG. 5 is a top perspective view showing a flat acoustic transducer according to a third embodiment.

FIG. 5 is a top perspective view showing the flat acoustic transducer 100 of the present embodiment. In the drawing, as in FIG. 1, the vibrating membrane 30 and the yoke 60 are spaced from each other, to show the state of the lower face side of the vibrating membrane 30.

In the flat acoustic transducer 100 of the present embodiment, a respective plurality of first magnets (permanent magnets) 10 and the second magnets (magnetic members) 20 are repeatedly arranged by pattern in two-dimensional directions.

That is, in the flat acoustic transducer 100 of the present embodiment, the first magnet 10 and the second magnet 20 are arranged in lattice shape or in zigzag shape.

As in the present embodiment, the flat acoustic transducer 100 where the first magnets 10 and the second magnets 20 are configured to be on a plurality of columns can be increased in width dimension. Therefore, the flat acoustic transducer 100 of the present embodiment is preferred as an application for a large-sized flat acoustic transducer, such as the case of use for a movie theater or a hall, or the case of changing a wall face of a house itself into a speaker.

Figure 6:
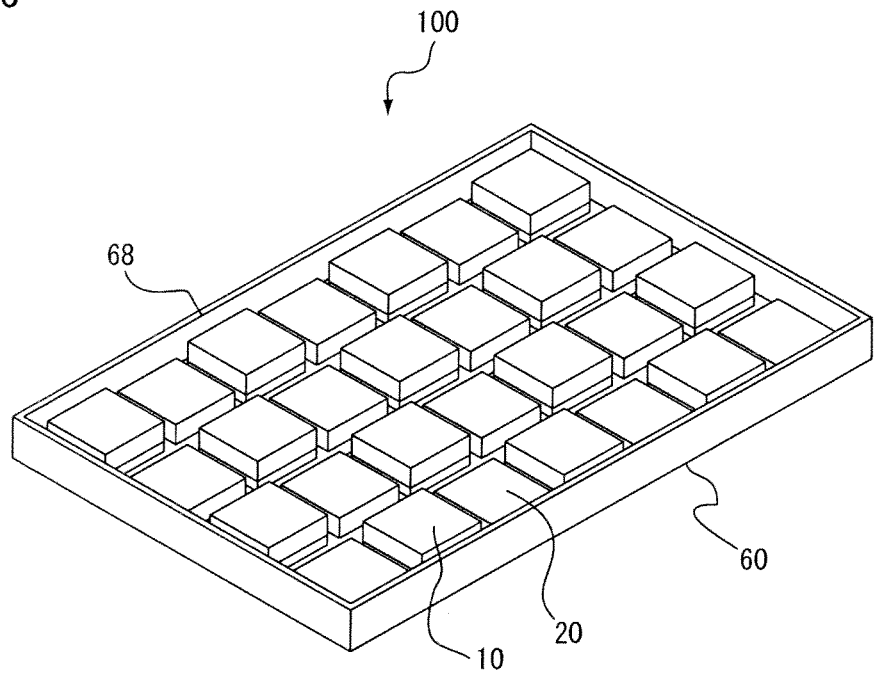
FIG. 6 is a top perspective view showing a flat acoustic transducer according to a modification of the third embodiment.

Further, FIG. 6 shows a modification of the present embodiment. The vibrating membrane 30 is not shown in the drawing.

In the present modification, the side wall section 68 made of the magnetic material is formed all around the yoke 60 on which the first magnets (permanent magnets) 10 and the second magnets (magnetic members) 20 are repeatedly arranged by pattern in two-dimensional directions. Thereby, the first magnet 10 and the second magnet 20 arranged on the outermost periphery form a magnetic circuit with the side wall section 68, thereby allowing improvement in, as well as in-plane uniformization of, driving power of the vibrating membrane 30.

Fourth Embodiment

Figure 7A:
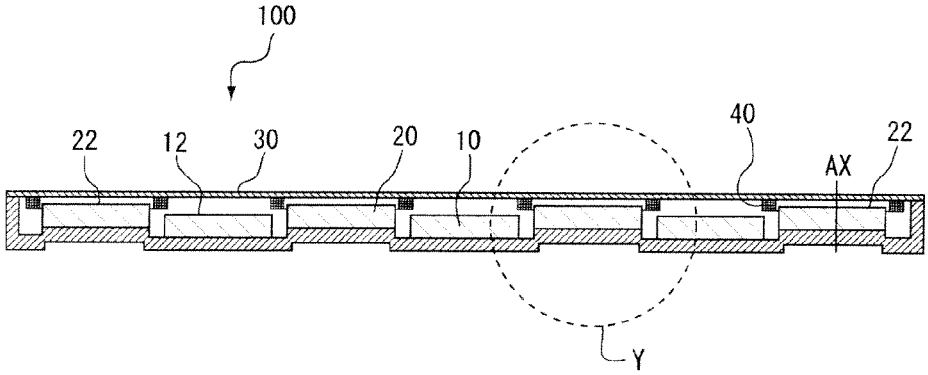
FIG. 7A is a vertical sectional view of a flat acoustic transducer according to a fourth embodiment.
Figure 7B:
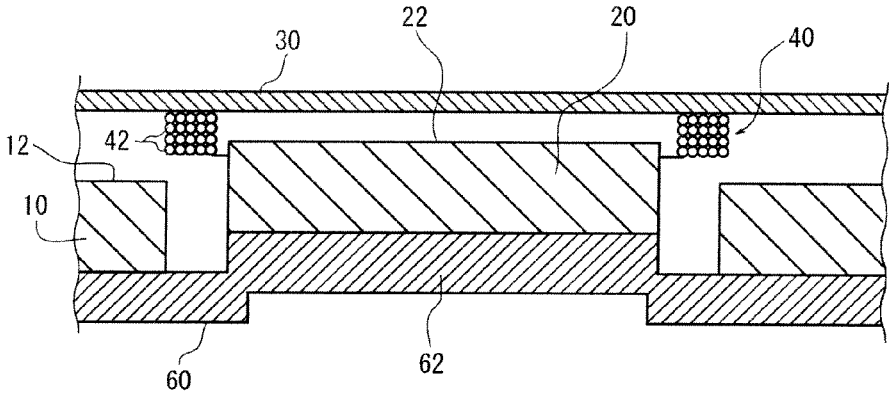
FIG. 7B is an expanded view of a broken-line area Y of FIG. 7A.

FIG. 7A is a vertical sectional view, cut along the longitudinal direction, of the flat acoustic transducer 100 of the present embodiment. FIG. 7B is an expanded view of a broken-line area Y of FIG. 7A.

In the present embodiment, the winding axis AX of the coil 40 coincides with the central axis of the upper face 22 of the second magnet (magnetic member) 20, while at least part of the winding 42 is provided surrounding the periphery of the second magnet 20.

The coil 40 is formed using an air-core coil similarly to the first embodiment and having an inner diameter larger than that of outer dimensions of the second magnet 20.

When the coil 40 vibrates in the vertical direction of the drawing along with the vibrating membrane 30, the upper face 22 of the second magnet 20 moves inside the air core of the coil 40 in non-contact with the winding 42.

Thereby, the second magnet 20 of the present embodiment acts as the core of the coil 40. Therefore, magnetic force received from the first magnet 10 and the second magnet 20 increases as compared with that in the first embodiment, thereby to improve driving force of the vibrating membrane 30.

It should be noted that as the coil 40, in the case of using a patterning coil with a thickness smaller than a half amplitude, the mount section 32 (see FIG. 2) to be provided between the coil 40 and the vibrating membrane 30 may be formed. That is, the ring-like mount section 32, provided with a larger hollow section than outer dimensions of the upper face 22 of the second magnet 20, is mounted between the coil 40 and the vibrating membrane 30, whereby it is possible to prevent the vibrating membrane 30 and the upper face 22 from interfering with each other, while arranging the coil 40 as the patterning coil at a position lower than the upper face 22.

Fifth Embodiment

Figure 8:
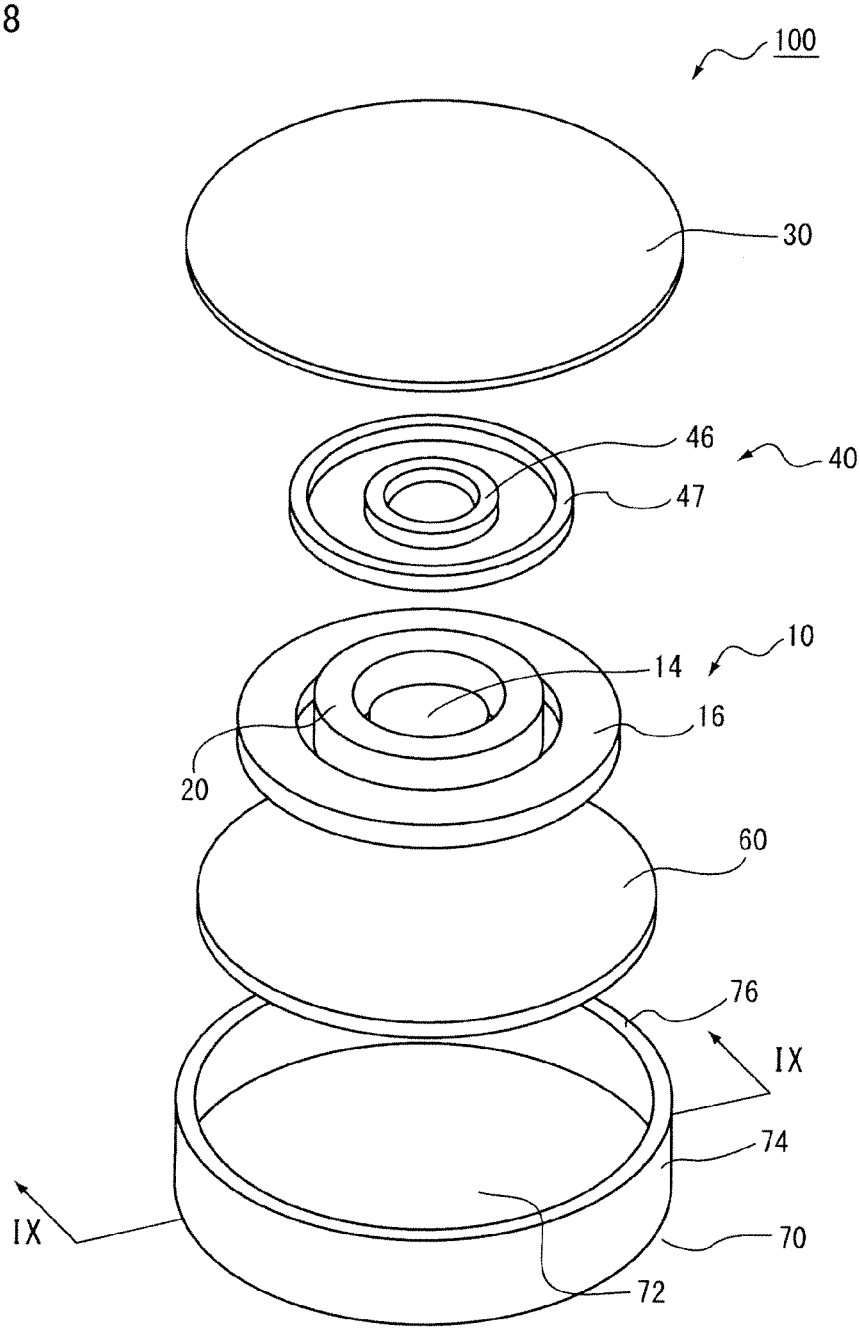
FIG. 8 is an exploded perspective view of a flat acoustic transducer of a fifth embodiment.

FIG. 8 is an exploded perspective view of the flat acoustic transducer 100 according to the present embodiment.

In the flat acoustic transducer 100 of the present embodiment, at least either the first magnet (permanent magnet) 10 or the second magnet (magnetic member) 20 forms a ring shape. The first magnet (permanent magnet) 10 and the second magnet (magnetic member) 20 are concentrically arranged.

Herein, as the ring shape, either an annular shape or a rectangular shape may be selected.

More specifically, the first magnet 10 of the present embodiment is formed by combination of a core magnet 14 in cylindrical shape with the smallest outer diameter and a magnet 16 in annular shape with the largest outer diameter. The second magnet 20 has outer dimensions of the middle between the core magnet 14 and the ring magnet 16, to form a ring shape. The core magnet 14, the second magnet 20, and the ring magnet 16 are concentrically arrayed in this order from the inside. These magnets are spaced from each other in respective diametrical directions with a predetermined interval.

Figure 9:
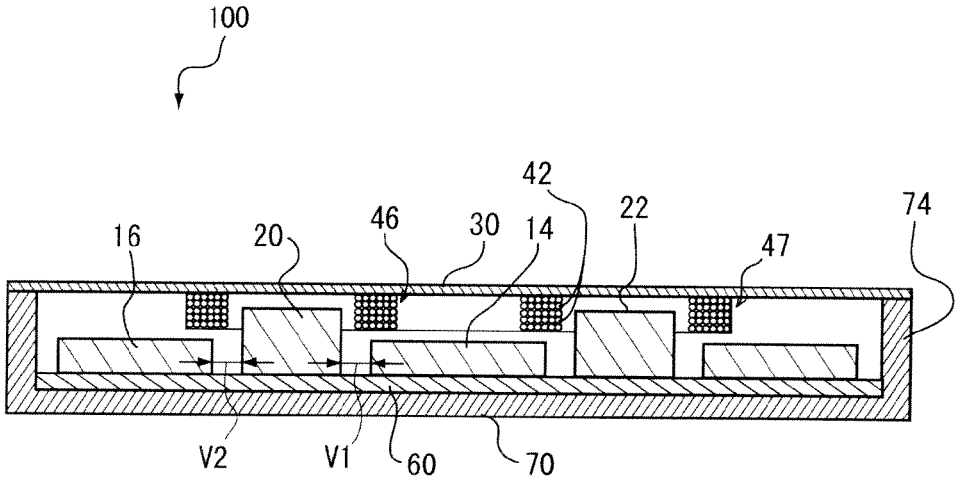
FIG. 9 is a sectional view of IX-IX in FIG. 8.

FIG. 9 is a sectional view of IX-IX of FIG. 8, showing a vertical sectional view, cut along the diametrical direction, of the flat acoustic transducer 100 of the present embodiment.

A height dimension of the second magnet 20 is larger than a height dimension of the first magnet 10 (the core magnet 14 and the ring magnet 16). The height dimensions of the core magnet 14 and the ring magnet 16 may coincide with or differ from each other.

These magnets are mounted on the yoke 60 made of a magnetic body forming the shape of a flat disk.

Further, the yoke 60 is fitted to the frame 70 in bottomed cylindrical shape. The erecting wall 74 is provided on the periphery of the bottom face 72 of the frame 70.

The vibrating membrane 30 of the present embodiment forms a disk shape. A peripheral edge of the vibrating membrane 30 is fixed to the top end face 76 of the erecting wall 74.

Out of the upper and lower principal faces of the vibrating membrane 30, the coil 40 is fitted to the lower face which faces the yoke 60. For the coil 40 of the present embodiment, the annular first coil 46 and the second coil 47, which are concentrically arranged, are used in combination. The first coil 46 and the second coil 47 are provided projecting downward from the vibrating membrane 30. At this time, the mount section 32 may, as necessary, be put between at least either the first coil 46 or the second coil 47 and the vibrating membrane 30 (see FIGS. 2B, 2C). In order to prevent the mount section 32 used in the present embodiment from interfering with the upper face 22 of the second magnet 20 at the time of vibration of the mount section 32 along with the vibrating membrane 30, the mount section 32 may be formed in ring shape in line with the shape of the coil 40 (the first coil 46, the second coil 47), and an area corresponding to the inner diameter of the coil 40 may be formed in concave shape.

As shown in FIG. 9, the first coil 46 is formed in an upper area of a gap V1 between the core magnet 14 and the second magnet 20, and the second coil 47 is formed in an upper area of a gap V2 between the second magnet 20 and the ring magnet 16. Then, at least part of the windings 42 of the first coil 46 and the second coil 47 are arranged at height positions lower than the upper face 22 of the second magnet 20 and higher than the upper faces of the core magnet 14 and the ring magnet 16.

In such a state, an electrical signal is applied to the first coil 46 and the second coil 47, and the first coil 46 thereby receives magnetic force from a static magnetic field generated between the core magnet 14 and the second magnet 20. Further, the second coil 47 receives magnetic force from a static magnetic field generated between the ring magnet 16 and the second magnet 20.

Further, also in the flat acoustic transducer 100 of the present embodiment, when the coil 40 (first coil 46, second coil 47) moves upward or downward from the middle of vibration, magnetic force received from the first magnet 10 and the second magnet 20 is symmetrized.

It should be noted that in the present embodiment, a non-magnetized magnetic body may be used for the core magnet 14 and the ring magnet 16 (first magnet 10) among the core magnet 14, the second magnet 20, and the ring magnet 16 which are concentrically arranged. Accordingly, since a plurality of coils (the first coil 46 and the second coil 47) can be driven by use of only one second magnet 20 as the permanent magnet, an advantage in terms of cost can be obtained.

In each of the above embodiments, the interval between the first magnet 10 and the second magnet 20, and the height of the step 50, are made common with respect to each set of the adjacent magnets. Further, the winding thickness and the number of turns are made common among the plurality of coils 40. However, the present invention is not restricted to this, but a variety of changes can be made.

For example, any one or more elements of the interval between the magnets, the height of the step 50, and the winding thickness and the number of turns of the winding 42 may be made different with respect to each in-plane area of the flat acoustic transducer 100, so that an amplitude generated in the vicinity of the center of the vibrating membrane 30 is substantially equal to an amplitude generated in the vicinity of the periphery when respective electrical signals are applied to the plurality of coils 40.

Specifically, in the first embodiment shown in FIG. 1, the interval between the first magnet 10 and the second magnet 20 in the vicinity of the periphery in the longitudinal direction of the base plane 64 may be made smaller than the interval in the vicinity of the center. Further, in the fifth embodiment shown in FIG. 9, the gap V2 between the ring magnet 16 and the second magnet 20 may be made smaller than the gap V1 between the core magnet 14 and the second magnet 20. Moreover, the number of turns of the coil 40 arranged in the vicinity of the periphery of the vibrating membrane 30 may be made larger than the number of turns of the coil 40 arranged in the vicinity of the center. Thereby, when a common electrical signal is applied to the plurality of coils 40, magnetic force received by the vibrating membrane 30 in the vicinity of the periphery is stronger than magnetic force received in the vicinity of the center. Accordingly, in the case of fixing the peripheral edge of the vibrating membrane 30 to the yoke 60 or the frame 70 (see FIG. 3A or 3B), an amplitude of the vicinity of the periphery which is close to such a fixed section and inferior in vibrating properties can be made substantially equal to an amplitude of the vicinity of the center which is superior in vibrating properties.

According to the flat acoustic transducer 100, the vibrating membrane 30 can perform reciprocating vibration in the perpendicular direction to the plane while being held flat, so as to obtain a vocal output with high directivity.

This application claims benefit of priority based upon Japanese Published patent application 2008-312656 filed on. Dec. 8, 2008, the contents of which are incorporated herein by reference in their entirety.

The invention claimed is:

1. A flat acoustic transducer comprising:

a permanent magnet and a magnetic member which are arranged adjacent to each other with a predetermined interval;

a flat vibrating membrane provided facing said permanent magnet and said magnetic member; and at least one coil fixed to said vibrating membrane, wherein an electrical signal is applied to said coil, to obtain vibration force on said vibrating membrane by way of a magnetic flux generated between a magnetic pole face of said permanent magnet and said magnetic member, a step is provided between said magnetic pole face and the upper face of said magnetic member, and at least part of a winding of said coil at the time of no application of said electrical signal is arranged inside said step.

2. The flat acoustic transducer as set forth in claim 1, wherein at least part of the winding of said coil at the time of no application of said electrical signal is arranged at such a height position that a density of said magnetic flux component parallel to a coil face of said coil is maximal.

3. The flat acoustic transducer as set forth in claim 2, wherein at least part of the winding of said coil at the time of no application of said electrical signal is arranged at a middle height position between said magnetic pole face and said upper face, and above a line segment connecting respective proximal edges of said magnetic pole face and said upper face.

4. The flat acoustic transducer as set forth in claim 1, wherein said magnetic member is another permanent magnet with a magnetic pole face having a polarity inverted from that of said adjacent permanent magnet.

5. The flat acoustic transducer as set forth in claim 1, wherein said coil is provided projecting from said vibrating membrane toward said permanent magnet or said magnetic member.

6. The flat acoustic transducer as set forth in claim 1, wherein a winding axis of said coil coincides with a central axis of said magnetic pole face or said upper face.

7. The flat acoustic transducer as set forth in claim 1, further comprising a yoke made of a magnetic material and provided with a step for mounting of said permanent magnet or said magnetic member.

8. The flat acoustic transducer as set forth in claim 7, wherein said yoke has side wall sections extending on sides with respect to an arraying direction of said permanent magnets and said magnetic members.

9. The flat acoustic transducer as set forth in claim 1, wherein a respective plurality of said permanent magnets and magnetic members are repeatedly arranged by pattern in a one-dimensional direction or two-dimensional direction.

10. The flat acoustic transducer as set forth in claim 1, wherein at least either said permanent magnet or said magnetic member forms a ring shape, while said permanent magnet and said magnetic member are concentrically arranged.

11. A method for driving a flat acoustic transducer that has a flat vibrating membrane fixed with at least one coil to which an electrical signal is applied, wherein a static magnetic field is generated such that a density of a magnetic flux component parallel to a coil face of said coil changes in a vibrating direction of said vibrating membrane, a step is provided between a magnetic pole face and the upper face of a magnetic member, and at least part of a winding of said coil at the time of no application of said electrical signal is arranged inside said step and said electrical signal is applied to said coil arranged at such a position that the density of said magnetic flux component is maximal, to vibrate said vibrating membrane.

* * * * *